US005857584A

United States Patent [19]

Taggart

[11] Patent Number: 5,857,584

[45] Date of Patent: Jan. 12, 1999

[54] DRINKING GLASS LINER

[76] Inventor: Terry O. Taggart, 307 Church St., Bloomingdale, Ga. 31302

[21] Appl. No.: 6,807

[22] Filed: Jan. 14, 1998

[51] Int. Cl.[6] ..... B65D 23/02

[52] U.S. Cl. ..... 220/719; 220/495.03; 220/23.9; 220/921; 220/732

[58] Field of Search ..... 220/495.03, 23.9, 220/719, 921, 732, 23.83, 23.86, DIG. 3, 920, 919, 918, 734, 731, 704, 716, 703

[56] References Cited

U.S. PATENT DOCUMENTS

| | | | |
|---|---|---|---|
| 378,794 | 1/1888 | Hodges . | |
| 1,026,154 | 5/1912 | Doughty | 220/921 |
| 1,758,827 | 5/1930 | Dudley | 220/495.03 |
| 2,357,063 | 4/1944 | Swing . | |
| 2,524,497 | 10/1950 | Tozzi | 220/23.9 |
| 2,690,064 | 5/1954 | Rupe . | |
| 2,753,049 | 12/1956 | Gaines et al. . | |
| 2,753,050 | 12/1956 | Langston . | |
| 3,061,129 | 10/1962 | Fitz Gerald . | |
| 3,150,084 | 9/1964 | Rodges . | |
| 3,160,119 | 12/1964 | Bowe et al. | 220/23.9 |
| 3,360,160 | 12/1967 | Spencer | 220/719 |
| 3,379,338 | 4/1968 | Marks et al. . | |
| 3,532,605 | 10/1970 | Riera . | |
| 3,549,044 | 12/1970 | Lerner | 220/719 |
| 3,917,533 | 11/1975 | Macaluso, Jr. . | |
| 3,940,012 | 2/1976 | Addington | 220/719 |
| 4,105,412 | 8/1978 | Petzinger | 220/23.9 |
| 4,642,934 | 2/1987 | Carlson et al. | 220/495.03 |
| 4,938,375 | 7/1990 | Fantacone | 220/719 |
| 5,284,028 | 2/1994 | Stuhmer . | |
| 5,370,258 | 12/1994 | Fair | 220/719 |
| 5,379,914 | 1/1995 | Martins . | |

*Primary Examiner*—Stephen J. Castellano
*Attorney, Agent, or Firm*—Hinkle & Associates, P.C.

[57] ABSTRACT

A drinking glass liner (20) is utilized to retain ice pieces within a drinking glass (10) and permit a liquid entrapped within the ice pieces to drain away from the ice pieces. The drinking glass liner comprises a mesh sheet (22) having a textured front side (24), interconnected links (32) which define openings (34), and ridges (44) extending outwardly from a back side (26). Protrusions (38) optionally may extend outwardly from the front side to additionally retard movement of ice pieces. The ridges are provided to create a gap (46) between an inner surface (14) of the drinking glass and the back side to enable the liquid to freely flow away from the ice pieces.

12 Claims, 2 Drawing Sheets

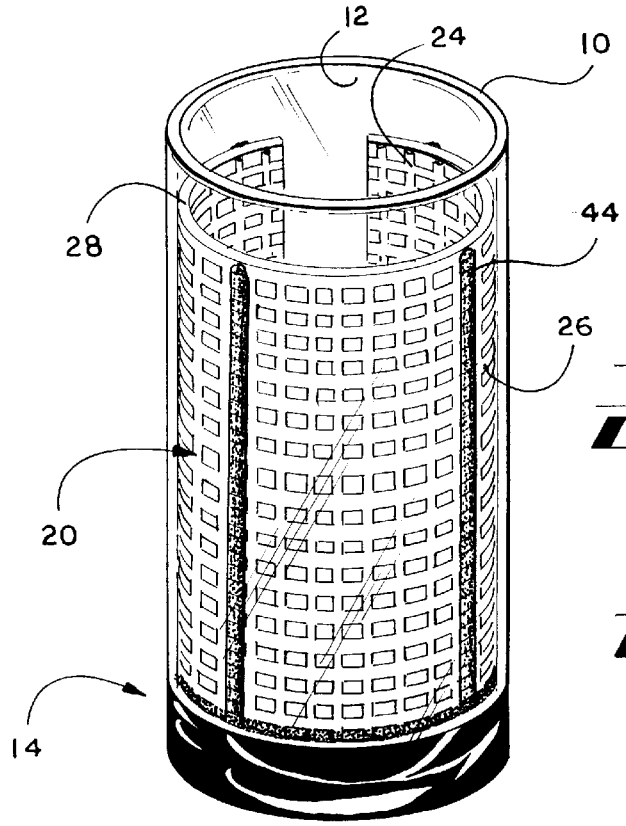
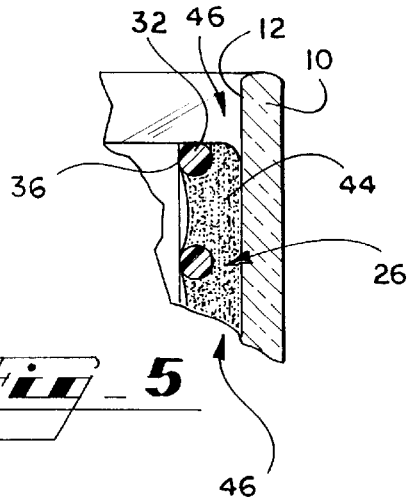
Fig. 5
Fig. 1
Fig. 2
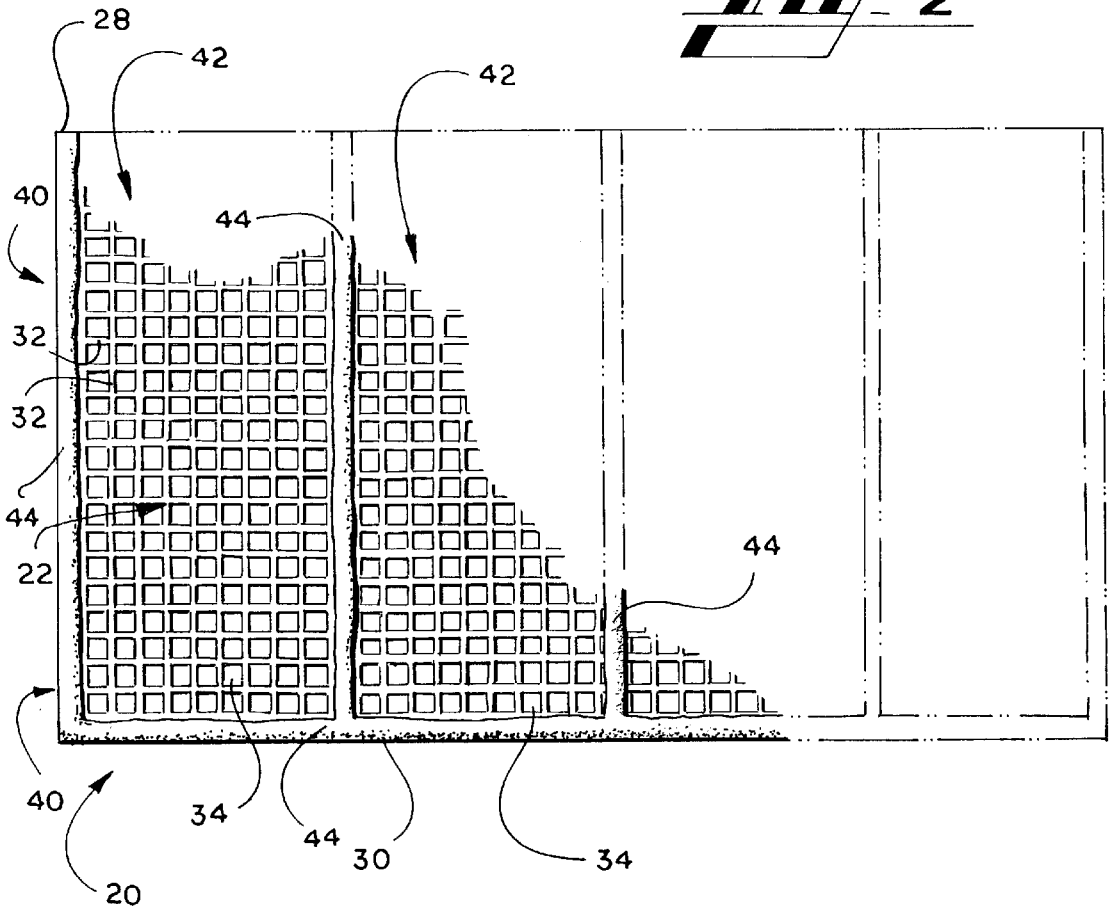

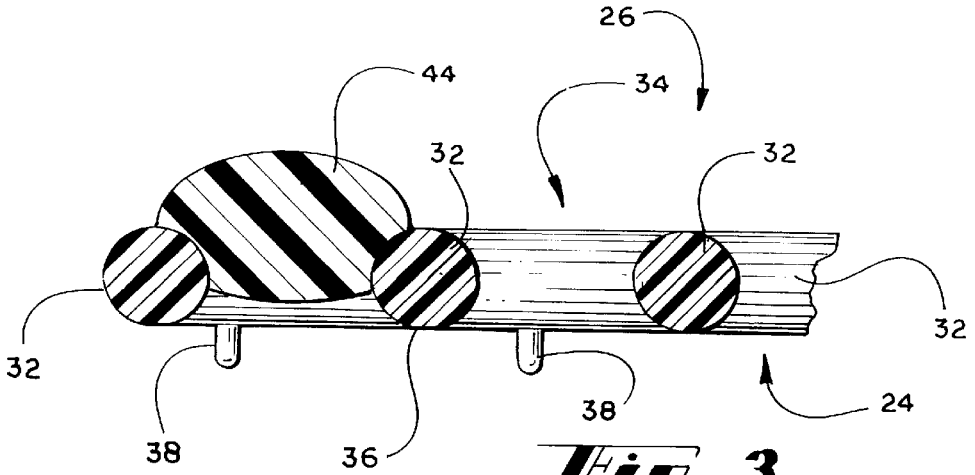
Fig. 3
Fig. 4
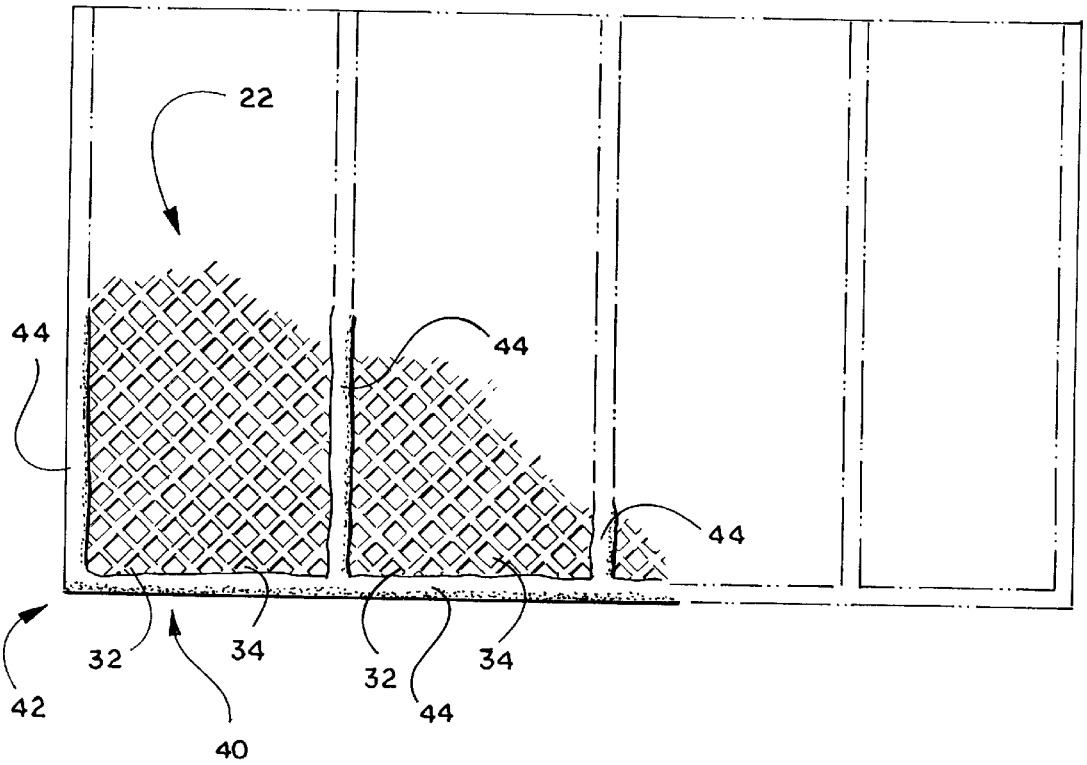

DRINKING GLASS LINER

BACKGROUND OF THE INVENTION

I. Field of the Invention

The present invention relates generally to the field of beverage containers. More particularly, the present invention relates to a liner for a drinking glass.

II. Description of the Related Art

It is common for a consumer of a liquid beverage to place ice pieces into a drinking glass to cool the consumer's beverage of choice, thereby enhancing the drinking experience. However, as the beverage within the drinking glass is imbibed, the ice pieces often slide along the wall of the drinking glass from the bottom toward the rim as the drinking glass is tilted. When the ice pieces reach the rim, the consumer is presented with the annoyance of having the ice pieces striking the consumer's mouth. Sometimes, particularly when the level of the beverage within the drinking glass nears the bottom, the ice pieces can form a weak bond with the drinking glass wall. In this circumstance, the ice pieces can break free from the wall as the consumer sips from the drinking glass. This, in turn, can result in an unanticipated and overwhelming amount of beverage at the consumer's mouth, thereby potentially causing a slightly embarrassing moment for the consumer.

Also, the ice pieces, especially crescent-shaped ice from typical domestic automatic ice dispensers, can entrap a portion of the beverage, particularly when most of the beverage has been removed from the drinking glass. Often, the consumer must undesirably maintain the drinking glass in a tilted position for an inordinate amount of time to allow the beverage to drain from the ice pieces.

U.S. Patents issued to Swing (U.S. Pat. No. 2,357,063), Rupe (U. S. Pat. No. 2,690,064), Gaines etal. (U.S. Pat. No. 2,753,049), Langston (U.S. Pat. No. 2,753,050 and Macaluso, Jr. (U.S. Pat. No. 3,917,533) show various devices which are placed into a drinking glass to block ice from coming into contact with the mouth of the consumer. Commonly, these devices are placed proximate the rim of the drinking glass and extend perpendicularly from the wall of the drinking glass toward the longitudinal axis thereof. Swing and Rupe show devices which extend fully across the opening of the glass, comparable to a lid having a small port. Gains et al. and Langston show devices which extend partially across the opening of the drinking glass a sufficient distance to block the ice. Macaluso, Jr. shows a device which clips to the rim and projects a guard downwardly into the drinking glass to form a protected volume in which ice and/or other floating solids are prevented from penetrating.

In U.S. Pat. No. 3,150,084, Rodges describes an ice guard having a arcuate base portion which is inserted into the glass. As shown in FIG. 2 of this patent, the base portion does not have a mesh. Rodges again teaches the use of a blocking device located within the glass proximate the rim which extends across the opening to block the ice.

Marks et al. in U.S. Pat. No. 3,379,338 describes a splash retarding vessel having a center core, cylindrically shaped device for preventing splashing of liquids contained within the vessel. This is a baffling device and the patent does not suggest that ice, or any other solid, is prevented from sliding along the wall toward the mouth of the drinker.

U.S. Pat. No. 3,061,129 issued to Fitz Gerald describes a baby nurser. The baby nurser has a pair of sections which are pivotally mounted to each other at the bottom to form a bottle that supports a flexible, plastic container generally utilized with nursing enfants. While engaging each other, the two sections form a cylindrically shaped bottle which has reticulated panels serving as vents. The walls of the baby nurser are rigid and the vents are provided strictly to provide access to the atmosphere from the interior of the bottle. As a child draws the fluid from the container, the container collapses, thereby preventing air from entering the child's stomach.

Stuhmer in U.S. Pat. No. 5,284,028 describes a ice holder incorporated within a beverage container. This device is basically a sealable, perforated bag that receives and retains ice.

SUMMARY OF THE INVENTION

In accordance with the present invention and the contemplated problems which have and continue to exist in this field, one of the objectives of this invention is to provide a drinking glass liner that is removably insertable into a drinking glass.

It is another object of the present invention is to provide a mesh sheet having ridges to enable liquid within a drinking glass to drain away from ice pieces therein.

Yet, it is another object of the present invention to provide a drinking glass liner that is dishwasher safe.

Still, it is another object of the present invention to provide a drinking glass liner that retains ice pieces within a drinking glass while the drinking glass is tilted.

This invention accomplishes the above and other objectives and overcomes the disadvantages of the prior art by providing a drinking glass liner that is simple in design and construction, inexpensive to fabricate, and easy to use. The drinking glass liner is utilized to retain ice pieces within a drinking glass and permit a liquid entrapped within the ice pieces to drain away from the ice pieces. The drinking glass liner comprises a mesh sheet having a textured front side, interconnected links which define openings, and ridges extending outwardly from a back side. Protrusions optionally may extend outwardly from the front side to additionally retard movement of ice pieces. The ridges are provided to create a gap between an inner surface of the drinking glass and the back side to enable the liquid to freely flow away from the ice pieces. In one embodiment, the openings are arranged in an array parallel to the ridges. Another embodiment has the openings arranged in an array that is oblique to the ridges.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein:

FIG. 1 is a perspective view of a drinking glass containing a drinking glass liner made in accordance with the present invention;

FIG. 2 is a front elevation view of the drinking glass liner of FIG. 1;

FIG. 3 is a partial, cross-sectional view of the drinking glass liner of FIG. 1;

FIG. 4 is another embodiment of the drinking glass liner made in accordance with the present invention; and FIG. 5 is a partial, cross-sectional view of the drinking glass liner engaging a wall of the drinking glass.

The reference numbers in the drawings relate to the following:

10=drinking glass

12=inner surface of drinking glass

14=bottom of drinking glass

20=drinking glass liner

22=mesh sheet

24=front side

26=back side

28=top edge

30=bottom edge

32=link

34=opening

36=surface of link

38=protrusion

40=row of openings

42=column of openings

44=ridges

46=gap

DESCRIPTION OF THE PREFERRED EMBODIMENTS

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a drinking glass 10 having an inner surface 12 and a bottom 14. Disposed within the drinking glass 10 is an embodiment of a drinking glass liner 20 made in accordance with the present invention. As shown, the drinking glass 10 has a cylindrical shape; however, this shape is presented solely for exemplary and discussion purposes. This invention is well suited for use with a drinking glass 10 having any desired shape, and therefore, the drinking glass 10 shown in FIG. 1 is not and should not be considered as limiting the present invention in any manner.

Referring now to FIGS. 2, 3 and 5, with continuing reference to FIG. 1, the drinking glass liner 20 is shown having a substantially rectangular shape. It is not required for the drinking glass liner 20 to have a rectangular shape, and the drinking glass liner 20 can be manufactured, formed or trimmed into any desired shape. In this example, by having a rectangular shape, the drinking glass liner 20 can be easily formed into a cylinder for insertion into the cylindrically-shaped drinking glass 10 described above and shown in FIG. 1.

The drinking glass liner 20 has a mesh sheet 22 having a front side 24, a back side 26, a top edge 28 and a bottom edge 30. The mesh sheet 22 comprises interconnected links 32 which define openings 34 therebetween. Each link 32 has a surface 36, and, preferably, the surface 36 is textured or rounded on the front side 24. Optionally, protrusions 38 can extend outwardly from the front side 24 to additionally retard movement of ice pieces engaging the drinking glass liner 20. In this embodiment, the openings 34 are arranged in substantially equal-distantly disposed rows 40 and columns 42 with the columns 42 aligned perpendicular to the top and bottom edges 28 and 30. Extending outwardly from the back side 26 between the top and the bottom edges 28 and 30 are a plurality of substantially parallel, raised ridges 44. The ridges 44 should extend from 3/16 inch to 1/8 inch from the back side 26. Additionally, the ridges 44 are spaced a predetermined distance from one another, preferably between 1 inch and 1½ inches apart, and are provided to create a gap 46 between the inner surface 14 of the drinking glass 10 and the back side 26. The gap 46 enables a liquid to freely flow away from the ice pieces. Disposed proximate the bottom edge 30 is another ridge 44.

With continuing reference to FIGS. 1, 3 and 5, FIG. 4 shows another embodiment of the drinking glass liner 20 made in accordance with the present invention. In this embodiment, the openings 34 of the mesh sheet 22 are arranged in substantially equal-distantly disposed rows 40 and columns 42 with the columns 42 aligned oblique to the top and bottom edges 28 and 30. The remaining features of this embodiment are consistent with the embodiment described above.

The mesh sheet 22 is preferably made from a flexible, heat resistant food-grade plastic, although other materials may be utilized. Likewise, the ridges 28 are preferably made from a resilient, heat-resistant food-grade plastic, although other materials may be utilized. Additionally, the material utilized for the ridges 28 can be a tacky material, such as hot melt glue. By utilizing a tacky material, a weak bond can be formed between the ridge 28 and the drinking glass 10 which assists in retaining the drinking glass liner 20 within the drinking glass 10.

In use, the drinking glass liner 20 is rolled into a cylinder by a consumer and inserted into the drinking glass 10 until the bottom edge 30 engages the bottom 14. Once released, the resiliency of the material comprising the drinking glass liner 20 causes the ridges 28 to engage the inner surface 12 of the drinking glass 10. Ice pieces (not shown) and a liquid (not shown) are placed into the drinking glass 10. The links 32 engage the ice pieces on the front side to prevent the ice from sliding along the drinking glass liner 20 while the drinking glass 10 is tilted. Further, liquid drains from the ice pieces into the gap 46. The drinking glass liner 20 is removable for cleaning by the consumer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Additionally, the openings 34 may have any desired shape.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A drinking glass liner for use within a drinking glass having an inner surface, the drinking glass liner comprising:

a flexible mesh sheet having a front side, a back side, a top edge and a bottom edge;

interconnected links disposed between the top and bottom edges and defining openings therebetween; and a plurality of substantially parallel, raised ridges extending outwardly from the back side and spaced a predetermined distance from one another for removably engaging the inner surface of the drinking glass and thereby creating a gap between the inner surface and the back side.

2. A drinking glass liner as claimed in claim 1, wherein each link has a surface and the surface is textured on the front side.

3. A drinking glass liner as claimed in claim 1, wherein protrusions extend outwardly from the front side.

4. A drinking glass liner as claimed in claim 2, wherein protrusions extend outwardly from the front side.

5. A drinking glass liner as claimed in claim 1, wherein the openings are arranged in substantially equal-distantly disposed rows and columns, and the columns are aligned perpendicular to the top and bottom edges.

6. A drinking glass liner as claimed in claim 2, wherein the openings are arranged in substantially equal-distantly disposed rows and columns, and the columns are aligned perpendicular to the top and bottom edges.

7. A drinking glass liner as claimed in claim 1, wherein the openings are arranged in substantially equal-distantly disposed rows and columns, and the columns are aligned oblique to the top and bottom edges.

8. A drinking glass liner as claimed in claim 2, wherein the openings are arranged in substantially equal-distantly disposed rows and columns, and the columns are aligned oblique to the top and bottom edges.

9. A drinking glass liner as claimed in claim 1, wherein another ridge is disposed proximate the bottom edge.

10. A drinking glass liner as claimed in claim 2, wherein another ridge is disposed proximate the bottom edge.

11. A drinking glass liner as claimed in claim 5, wherein another ridge is disposed proximate the bottom edge.

12. A drinking glass liner as claimed in claim 7, wherein another ridge is disposed proximate the bottom edge.

* * * * *